US005106306A

United States Patent [19]

Ditzig

[11] Patent Number: 5,106,306

[45] Date of Patent: Apr. 21, 1992

[54] ROTARY ELECTRICAL CONNECTOR WITH REMOTE MODULAR CONNECTOR

[75] Inventor: Albert Ditzig, Hoffman Estates, Ill.

[73] Assignee: Telephone Products, Inc., Wheeling, Ill.

[21] Appl. No.: 722,317

[22] Filed: Jun. 27, 1991

Related U.S. Application Data

[63] Continuation-in-part of Ser. No. 647,005, Jan. 29, 1991.

[51] Int. Cl.[5] ..... H01R 35/00; H01R 23/02

[52] U.S. Cl. ..... 439/26; 439/676

[58] Field of Search ..... 439/13, 18, 20–26, 439/28, 29, 676, 502

[56] References Cited

U.S. PATENT DOCUMENTS

| | | | |
|---|---|---|---|
| 2,200,794 | 5/1940 | Krantz | 439/23 |
| 2,265,846 | 12/1941 | Krantz | 439/26 |
| 2,288,259 | 6/1942 | Gladulich | 439/26 |
| 3,185,951 | 5/1965 | LeBeau | 439/26 |
| 3,243,866 | 4/1966 | Pandapas et al. | 439/20 |
| 3,297,973 | 1/1967 | Wendell | 439/26 |
| 3,321,728 | 5/1967 | Cocco et al. | 439/26 |
| 3,375,479 | 3/1968 | Lowe | 439/26 |
| 3,430,180 | 2/1969 | Brown | 439/23 |
| 3,437,976 | 4/1969 | Nelson | 439/23 |
| 3,686,514 | 8/1972 | Dube et al. | 439/20 |
| 4,438,998 | 3/1984 | Myers | 439/638 |
| 4,472,010 | 9/1984 | Parnello | 439/14 |
| 4,533,796 | 8/1985 | Engelmore | 439/24 |
| 4,583,797 | 4/1986 | Engelmore et al. | 439/22 |
| 4,583,798 | 4/1986 | Blazowich | 439/24 |
| 4,673,228 | 6/1987 | Ditzig | 439/21 |
| 4,764,121 | 8/1988 | Ditzig | 439/21 |
| 4,854,881 | 8/1988 | Ditzig | 439/26 |

FOREIGN PATENT DOCUMENTS 172266 8/1952 Austria .

*Primary Examiner*—Gary F. Paumen

*Attorney, Agent, or Firm*—Marshall, O'Toole, Gerstein, Murray & Bicknell

[57] ABSTRACT

A rotary connector, for preventing the tangling of a telephone cord, comprises a housing carrying within it a female modular connector. Also located within the housing is a sub-assembly comprising a spindle and a connector member which engages a shank of the spindle. The sub-assembly comprises structure for electrically connecting a plurality of peripheral spindle rings to one end of a cable extending from within the connector member outwardly to a male modular connector remote from the housing. The spindle rings are engaged by wipers electrically connected to contact elements on the female modular connector, which carries the wipers. The housing and the female modular connector rotate as a unit relative to the sub-assembly.

27 Claims, 5 Drawing Sheets

ROTARY ELECTRICAL CONNECTOR WITH REMOTE MODULAR CONNECTOR

RELATED APPLICATION

This is a continuation in part of design application Ser. No. 07/647,005 filed Jan. 29, 1991, and the disclosure thereof is incorporated herein by reference.

BACKGROUND OF INVENTION

The present invention relates generally to electrical connectors for connecting a power or communication cable to an appliance or telecommunication equipment and more particularly to a rotary electrical connector for a telephone handset.

A rotary electrical connector is used, for example, in conjunction with a cable that connects the handset to the base of a telephone. The purpose of the rotary electrical connector is to prevent the cable from becoming tangled or twisted when used over an extended period of time, which is undesirable.

Rotary connectors generally comprise a spindle at least part of which is contained within a housing. The spindle and the housing are mutually rotatable, in relation to each other, about a common axis. Male and female modular electrical connector's are associated with one or both of the housing and the spindle. The female modular connector associated with the rotary connector receives a male modular connector normally located at one end of the telephone cable, and the male modular connector associated with the rotary connector normally plugs into a female modular connector on the telephone, typically on the handset thereof.

The spindle typically has electrically conductive rings located around its periphery, and these rings are connected by electrically conductive connecting means, extending through the spindle, to electrical contact elements on one of the modular connectors or to other connections with the telephone equipment. The rings are engaged by electrical contact members or wipers typically electrically connected to the other modular connector associated with the rotary connector or to the cord or cable conventionally extending between the handset and the base. There is thus formed a rotatable electrical connection between the telephone cable and the handset.

Examples of rotary electrical connectors of the general type described above are disclosed in Ditzig U.S. Pat. Nos. 4,673,228 issued June 16, 1987 and 4,764,121 issued Aug. 16, 1988. These patents disclose, for the most part, rotary connectors which are separate and discrete from the telephone itself, and are used to retrofit the telephone rather than being part of the original telephone equipment. There are also rotary connector assemblies which are part of the original telephone equipment, these assemblies being "hardwired" to the cable for the telephone handset, for example, and being removably connected internally within the handset and normally inaccessible for removal purposes. Such an assembly is disclosed in Ditzig U.S. Pat. No 4,854,881 issued Aug. 8, 1989. The disclosures of the three aforementioned Ditzig U.S. Patents are incorporated herein by reference.

Rotary connectors of the type disclosed in the first two of the above-identified patents normally project directly from one end of the telephone handset, without any cable connection between the rotary connector and the telephone handset. There is a problem which can arise when an arrangement of that type is utilized. This problem occurs when the telephone handset is inadvertently dropped against a hard surface. The rotary connector projecting from the handset can strike the surface first, absorbing the entire impact of the fall, and if the impact occurs toward the rotary connector end remote from the connection to the handset, the resulting torque can cause the rotary connector to break off from the handset adjacent the end of the rotary connector which engages the handset.

One way of avoiding the problem described in the previous paragraph is to utilize a flexible cable between (a) the male modular connector which engages the rotary connector to the telephone handset and (b) the rotary connector per se. With such an arrangement, the impact is absorbed by the flexible cable between the rotary connector and the male modular connector. Such an arrangement is illustrated in FIG. 13 in the above-identified Ditzig U.S. Pat. No 4,673,228. However, the arrangement disclosed in FIG. 13 of U.S. Pat. No. 4,673,228 has other problems associated with it. More particularly, the wires from the cable generally extend through the interior of the spindle and then are wrapped around the exterior of the spindle to form the spindle rings. It is generally desirable to gold plate the spindle rings to improve the electrical connection between the spindle rings and the contacts or wipers which engage the spindle rings. There are problems associated with trying to gold plate the ends of cable wires which form spindle rings These problems are not associated with spindle rings which are separate and discrete from the cable wires connected to the spindle The above-identified Ditzig U.S. Pat. No. 4,854,881 discloses an arrangement in which the spindle rings are separate and apart from the cable wires which connect the spindle ring to the telephone handset, but this arrangement requires the utilization of a shorting element or contact jumper to connect the spindle rings to the cable wires.

There is another problem associated with arrangements in which the spindle rings are connected to a male modular connector by an intermediate cable,—namely a possibility that the spindle and the cable will pull away from each other at their connection.

SUMMARY OF THE INVENTION

A rotary connector in accordance with the present invention employs a male modular connector which is remote from the rotary connector and electrically connected thereto by a flexible cable. The rings on the spindle are separate and discrete from the wires on the cable, and the connection between the spindle rings and the cable wires does not employ shorting elements or contact jumpers. The spindle rings can be readily gold plated, because they are separate and discrete from the wires on the cable connecting the rotary connector to the male modular connector.

The spindle rings are electrically connected to the cable wires by a structural arrangement which prevents the spindle and the cable from being readily pulled apart. This is accomplished by employing (1) a male connector member at one end of the spindle and (2) a female connector member which is (a) at one end of the cable and (b) in mating engagement with the male connector member, within the housing.

Other features and advantages are inherent in the structure claimed and disclosed or will be apparent to those skilled in the art from the following detailed description in conjunction with the accompanying diagrammatic drawings.

DETAILED DESCRIPTION

Figure 1:
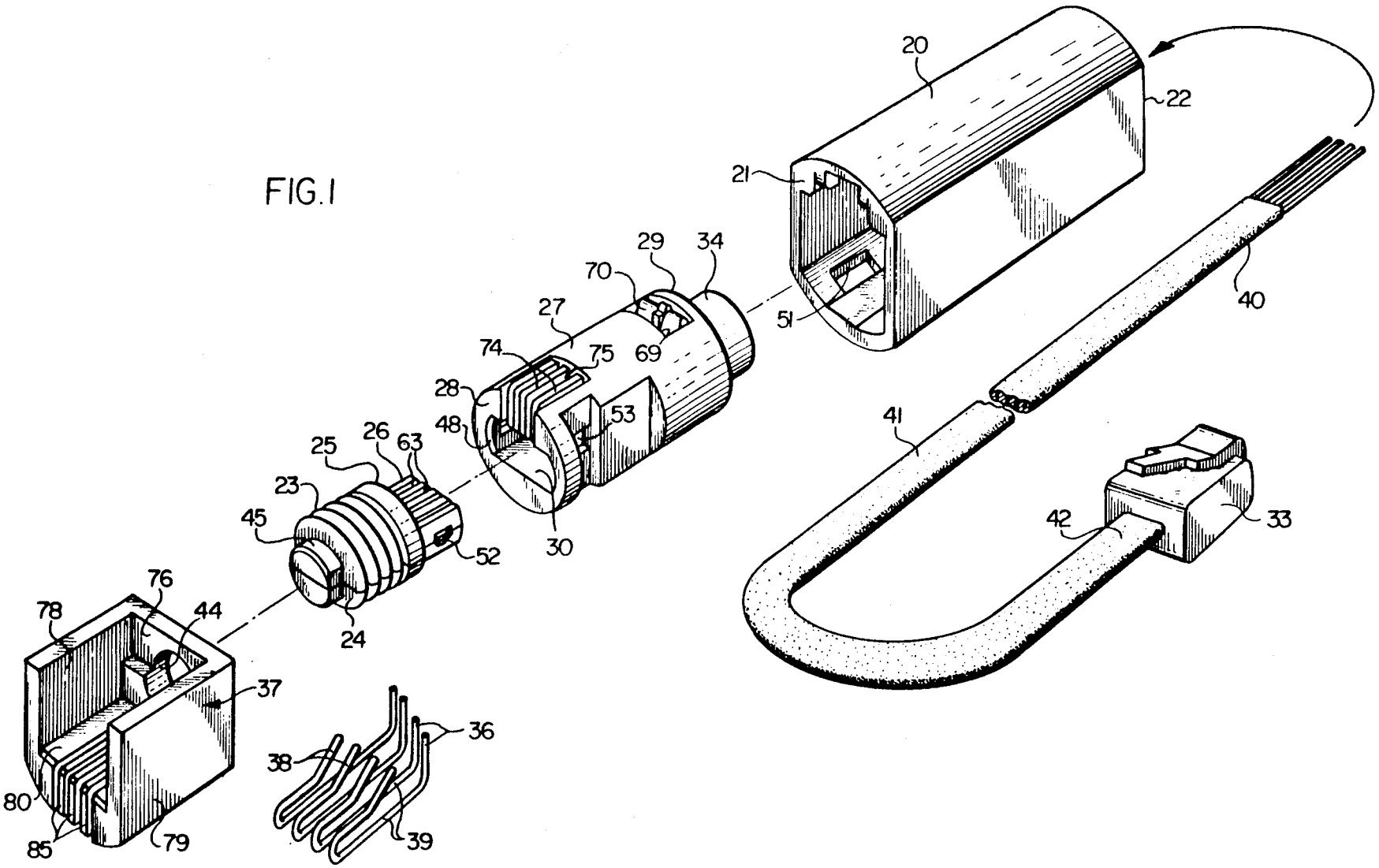
FIG. 1 is an exploded perspective of a rotary electrical connector with a remote male modular connector element, constructed in accordance with an embodiment of the present invention.
Figure 2:
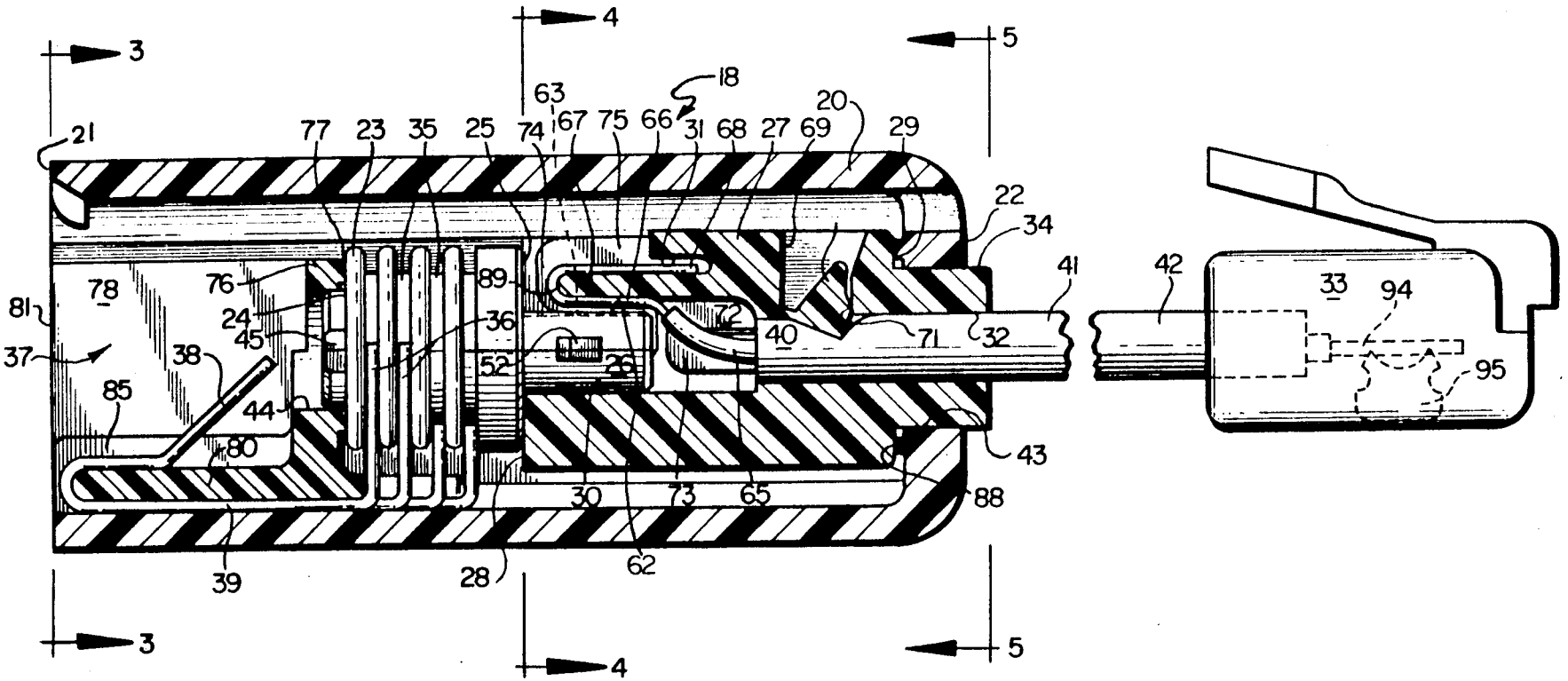
FIG. 2 is a longitudinal sectional view of the embodiment of FIG. 1.
Figure 3:
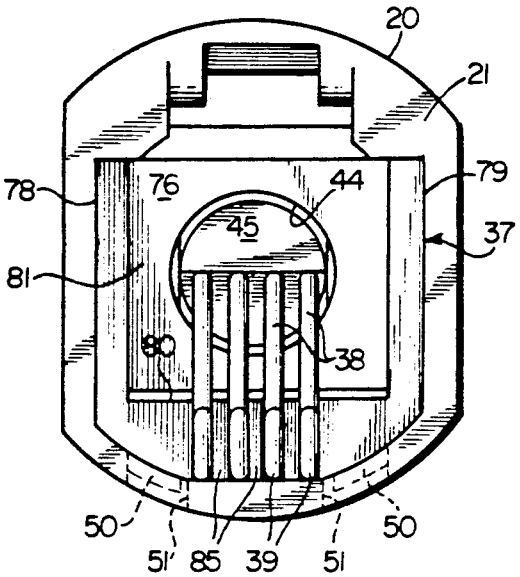
FIG. 3 is a sectional view taken along line 3—3 in FIG. 2.

Referring initially to FIGS. 1 and 2, indicated generally at 18 is a rotary connector constructed in accordance with an embodiment of the present invention. Connector 18 comprises a housing 20 having a pair of opposite ends 21, 22. Located within housing 20 is a spindle 23 having a pair of opposite ends 24, 25. Housing 20 and spindle 18 have a mutual axis of rotation, and the spindle is mounted for rotation relative to housing 20 about their mutual axis, employing mounting structure to be described subsequently. Both spindle ends 24, 25 are located within housing 20, and each spindle end 24, 25 faces a respective housing end 21, 22.

Located substantially between spindle end 25 and housing end 22, is a connector member 27 which receives and retains one end portion 40 of a cable 41 having another end portion 42 connected to a male modular connector 33 remote from housing 20. Cable 41 extends into housing 20 through an opening 43 in housing end 22. Male modular connector 33 is a conventional device which is commercially available; and it may be of the type in which the cable wires 94 at cable end 42 are engaged by barbed contact elements 95 on connector 33 to electrically connect the cable wires to the contact elements.

Disposed around the periphery of spindle 23 are a plurality of electrically conductive spindle rings 35. Each spindle ring 35 is located between spindle ends 24, 25 and is rotatable with spindle 23.

Located within housing 20, between housing end 21 and spindle end 24, is a female modular connector 37. Female modular connector 37 is mounted for rotation with housing 22, relative to spindle 23, employing mounting structure to be subsequently described.

Electrically engaging each spindle ring 35 is an electrically conductive wiper 36 integral with a connective portion 39 in turn integral with a contact element 38 located within female modular connector 37. Female modular connector 37 carries each contact element 38, connective portion 39 and wiper 36, thereby mounting wipers 36 for rotation, with female modular connector 37 and housing 20, relative to spindle 23.

Spindle rings 35 are electrically connected to cable end portion 40 at connector member 27 in a manner to be subsequently described.

The net result of the structure described in the preceding paragraphs is to form an electrical connection between female modular connector 37 and male modular connector 33 and to allow housing 20, female modular connector 37 and wipers 36 to rotate together relative to spindle 23.

The structure which connects various elements of rotary connector 18 together will now be described. Located on the bottom of housing 20, near housing end 21, are a pair of openings 51 (FIG. 1) each for receiving a respective lug 50 located on the bottom of female modular connector 37 (FIGS. 11-12 and 14-15). The engagement of lugs 50 in openings 51 locks female modular connector 37 in place within housing 20 and mounts female modular connector 37 for rotation with housing 20 about the mutual axis of housing 20 and spindle 23.

Female modular connector 37 comprises an inner wall 76 having an opening 44 which rotatably receives a spindle shaft 45 extending from spindle end 24. Extending from the other spindle end 25 is a spindle shank 26 received within a pocket 30 extending inwardly from an end 28 of connector member 27 adjacent spindle end 25. Extending laterally outwardly from each side of shank 26 is a lug 52. Located on each of a pair of opposite sides of pocket 30 of member 27 is an opening 53. Each lug 52 engages an opening 53, and this engagement retains spindle shank 26 within pocket 30 and connects spindle 23 and member 27 for movement together.

Connector member 27 has an end 29 opposite its end 28 and adjacent housing end 22. The interposition of connector member 27 between spindle 23 and housing end 22 maintains spindle rings 35 remote from housing end 22. Extending in an axial direction from connector end 29 is a shank 34 received within an opening 43 at end 22 of housing 20. Extending inwardly from housing end 22, around opening 43, is a thrust-bearing 64 for engaging end 29 of member 27. A similar thrust bearing 77 extends inwardly from inner wall 76 of female modular connector 37 for engaging spindle end 24.

Shank 34 on member 27 is rotatably mounted within opening 43. This rotatable mounting, together with the rotatable mounting of spindle shaft 45 in opening 44 of female modular connector 37, mounts housing 20 and female modular connector 37 for rotatable movement together relative to spindle 23 and member 27. Male modular connector 33 and cable 41 are connected to member 27, and male modular connector 33 and cable 41 do not rotate with housing 20 and female modular connector 37.

Figure 4:
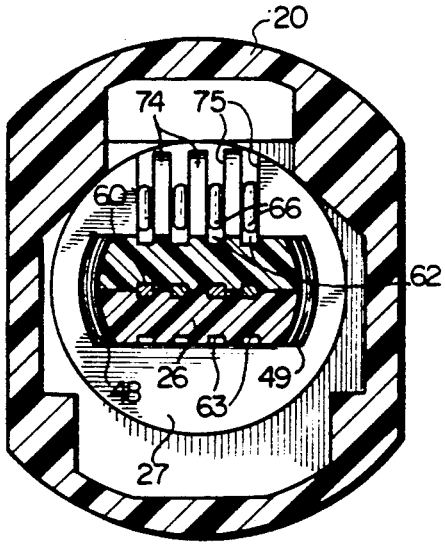
FIG. 4 is a sectional view taken along line 4—4 in FIG. 2.
Figure 5:
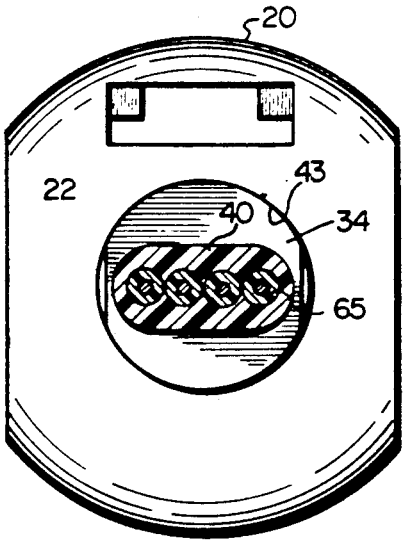
FIG. 5 is a sectional view taken along line 5—5 in FIG. 2.
Figure 6:
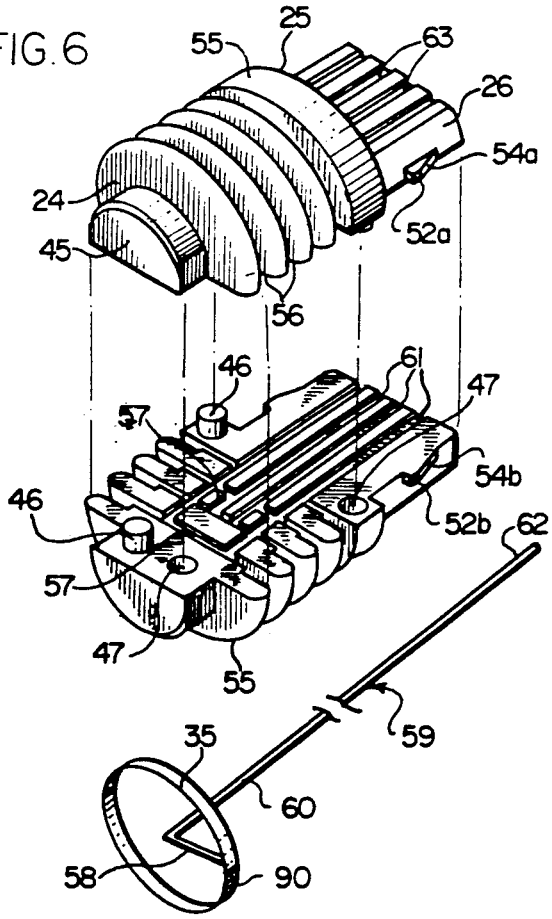
FIG. 6 is an exploded perspective of an embodiment of a spindle and spindle ring employed in accordance with the present invention.
Figure 7:
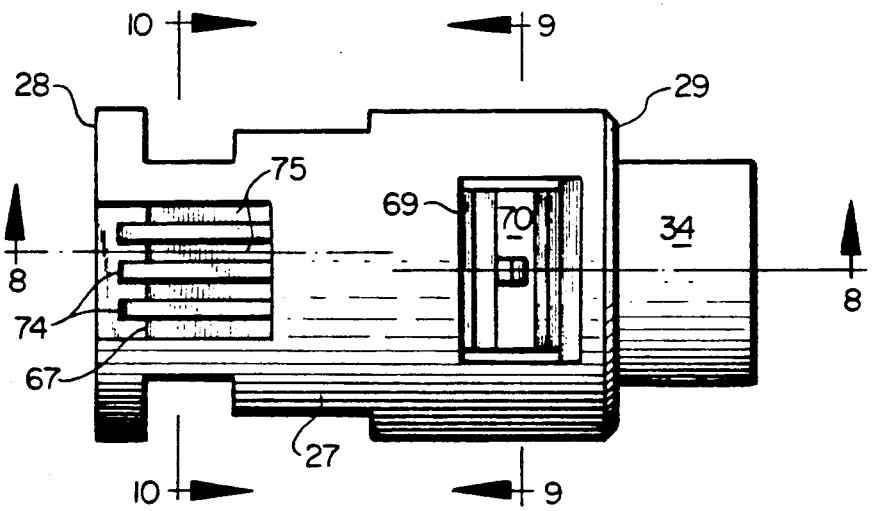
FIG. 7 is a plan view of a female connector member employed to connect the spindle ring to the wires of a cable, in accordance with an embodiment of the present invention.

The electrical connection between spindle rings 35 and cable 41 will now be described with reference to Figs. 2, 4 and 6. As shown in FIG. 6, spindle 23 comprises a pair of mating spindle halves 55 each defining one-half of a plurality of peripheral grooves 56 each for receiving a spindle ring 35. Each spindle half 55 also defines one-half of a shallow lateral groove 57 for receiving a laterally extending portion 58 of an electrically conductive, strip-like connector 59 having a longitudinal portion 60 received in a shallow longitudinal groove 61 defined by spindle halves 55. Connector 59 terminates at an uninsulated terminal portion 62 which, as shown in FIG. 2, is bent up and back onto the outer surface of spindle shank 26 which contains shallow grooves 63 each for receiving the bottom part only of a terminal portion 62. Groove 63 confines terminal portion 62 against lateral movement. Connector 59 is composed of a resilient material which normally urges terminal portion 62 slightly angularly upwardly (outwardly) relative to groove 63.

Figure 16:
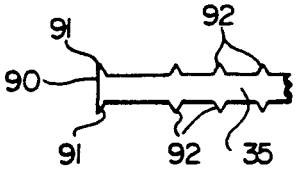
FIG. 16 is a fragmentary plan view of a portion of a spindle ring in accordance with an embodiment of the present invention.
Figure 15:
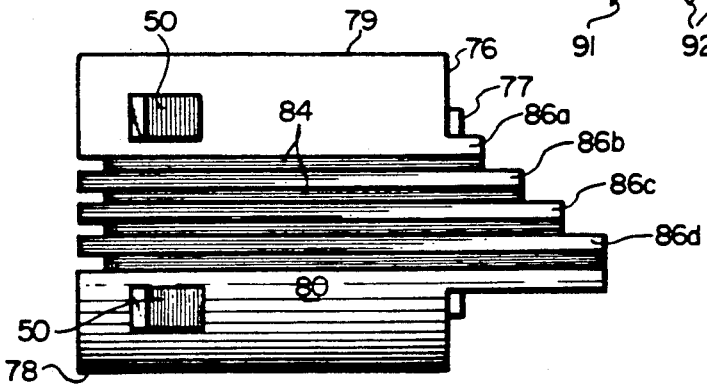
FIG. 15 is a bottom view of the female modular connector of FIGS. 11-14.

Each spindle ring 35 is initially shaped as a strip which is formed into a ring around peripheral spindle groove 56. Ring 35 has a free edge 90 (FIG. 16) with barbs or teeth 91 for engaging the molded plastic sides of peripheral spindle groove 56 to prevent free edge 90 from projecting outwardly from the circumferential plane of the ring. Other barbs 92 are located along the side edges of ring 35 for engaging the sides of peripheral spindle groove 56 to retain ring 35 in place in groove 56.

Spindle rings 35, wipers 36, contact elements 38 on female modular connector 37 and contact elements 95 on male modular connector 33 should be gold plated.

End portion 40 of cable 41 comprises a plurality of wires each having an insulated part 65 and each terminating at an uninsulated part 66. Each uninsulated wire part 66 corresponds to a respective uninsulated terminal portion 62 on connector 59. There are four wires in cable 41, and each wire is multi-stranded, e.g. 7 strands or 19 strands twisted together to form the wire.

Figure 8:
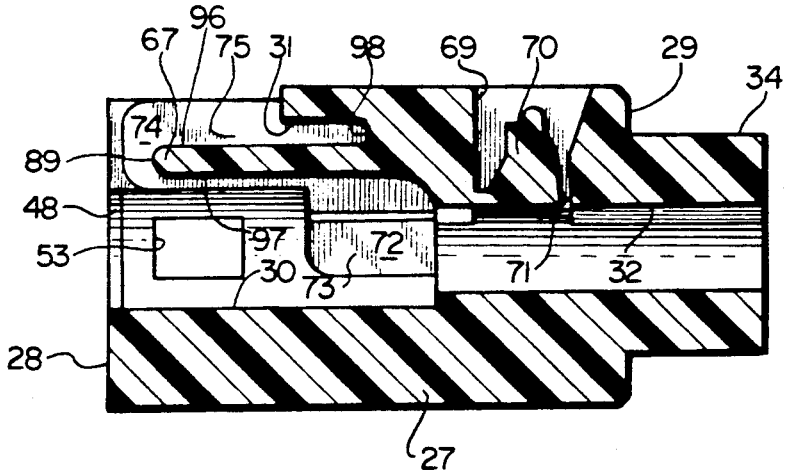
FIG. 8 is a sectional view taken along line 8—8 in FIG. 7.
Figure 9:
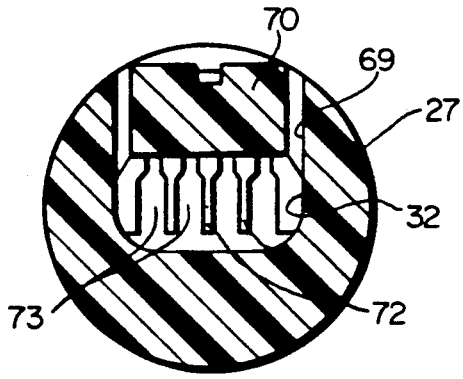
FIG. 9 is a sectional view taken along line 9—9 in FIG. 7.
Figure 10:
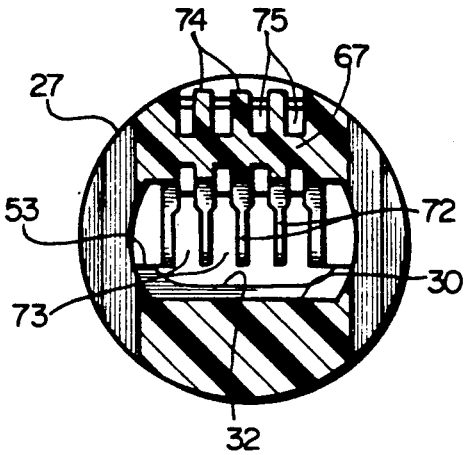
FIG. 10 is a sectional view taken along line 10—10 in FIG. 7.
Figure 11:
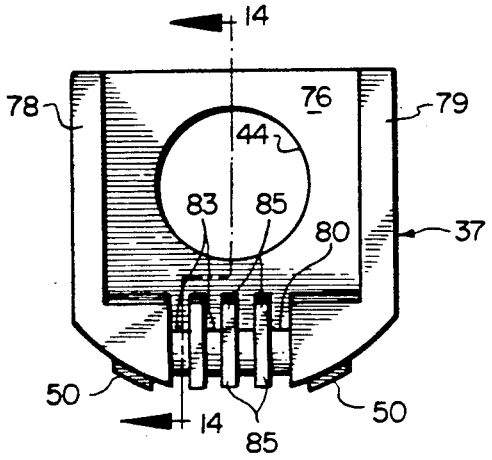
FIG. 11 is a rear view of a female modular connector in accordance with an embodiment of the present invention.

Uninsulated wire part 66 is bent around the outer end portion 89 of a shelf 67 overlying and defining one wall of pocket 30, in the manner shown in FIG. 2. Shelf 67 has a pair of opposed surfaces 96, 97 terminating at the shelf's outer end portion 89 (FIG. 8). Uninsulated wire part 66 has a free end 68 received within a slit 31 located above shelf 67 adjacent the inner end 98 of the shelf. When spindle shank 26 is received within pocket 30 of connector member 27, the spindle shank and the pocket cooperate to hold each uninsulated wire part 66 in electrically conducting, press-fit engagement with a corresponding terminal portion 62 of connector 59. More particularly, the outer grooved surface of spindle shank 66 and inner surface 91 of shelf 67 sandwich between them uninsulated wire part 66 and uninsulated terminal portion 62 of connector 59, with terminal portion 62 and uninsulated wire part 66 extending in longitudinal, side-by-side, contacting relation. The resiliency of terminal portion 62, which normally urges terminal portion 62 angularly upwardly (outwardly) relative to groove 63, facilitates the contact and electrical connection between terminal portion 62 and uninsulated wire part 66.

Communicating with pocket 30 of member 27 is a channel 32 through which extends end portion 40 of cable 41. Cable portion 40 is pinchingly engaged by a conventional pinch element 70 integral with member 27, and this helps hold cable end portion 40 within channel 32 to prevent the cable from being withdrawn from member 27.

Spindle shank 26 is received within pocket 30 at an outer end portion of the pocket. Referring now to FIGS. 2 and 7–10, located at the inner end portion of pocket 30 are a plurality of dividers 72 defining a plurality of passageways 73 each for receiving a respective insulated wire part 65 and for confining wire part 65 against lateral movement. In a similar manner, extending along shelf 67 are a plurality of dividers 74 defining a plurality of passageways 75 each for receiving an uninsulated wire part 66 (FIGS. 1 and 4) and for confining wire part 66 against lateral movement. Each passageway 75 has a closed, inner end 98 at slit 31 and an open, outer end adjacent outer end portion 89 of shelf 67 (FIG. 8).

Spindle halves 55 are identical. Each spindle half comprises pins 46 and sockets 47 for engagement with corresponding sockets and pins on the other spindle half 55 to secure the two spindle halves 55 together. Each spindle half 55 includes one-half of each lug 52 located on spindle shank 26. Each half lug **52*a*, 52*b* has a wedge-like surface 54*a*, 54*b*, respectively. The wedges 54*a*, 54*b* on lugs 52*a*, 52*b* deform the walls of element 27 adjacent openings 53 in element 27 to enable lugs 52 to enter openings 53 following which the previously deformed walls of element 27, composed of a resilient plastic material, return to their undeformed condition to facilitate the retention of lugs 52 within openings 53**.

Pocket 30 has a cross-sectional shape and interior dimensions which correspond substantially to the cross-sectional shape and exterior dimensions of spindle shank 26 (except, of course, for lugs 52 on spindle shank 26). Pocket 30 thus acts as a guide for spindle shank 26 so that when the shank is introduced into the pocket, each outside groove 63 on the spindle shank is aligned with a respective lower and upper passageway 73, 75. This in turn ensures that uninsulated terminal portions 62 of connector 59 will be aligned properly with uninsulated wire parts 66 of cable end portion 40 to effect the desired electrically conducting, press-fit engagement between the two.

The entry to pocket 30 has converging side surfaces 48, 49 to guide spindle shank 26 into alignment with pocket 30 to facilitate insertion of the shank into the pocket.

Pinch element 70 initially has the undeformed disposition shown in FIG. 8 to facilitate the insertion of cable end portion 40 through channel 32 so as to position wire portions 65 and 66 in pocket 30. After cable end portion 40 has attained the position shown in FIG. 2, pinch element 70 is deformed from the disposition shown in FIG. 8 to the pinching disposition shown in FIG. 2 in which disposition pinch element 70 is retained due to the engagement of pinch element 70 with a wall portion 71 of the recess 69 in which pinch element 70 is located.

Referring again to the electrical connection between spindle rings 35 and cable 41, there is, in effect, a mating engagement between male and female connector members within housing 20 to bring about that electrical connection. More particularly, spindle shank 26 constitutes a male connector member at one end of spindle 23 and having exposed contact elements defined by terminal portions 62. Member 27 constitutes a female connector member, separate and discrete from spindle 23 and housing 20, and located adjacent spindle end 25. Uninsulated wire parts 66 define the exposed contact elements on the female connector member.

Figure 12:
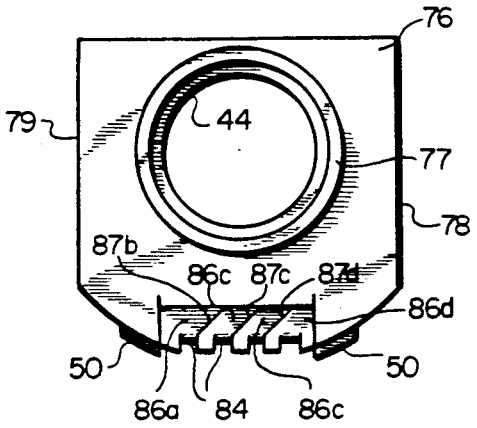
FIG. 12 is a front-end view of the female modular connector of FIG. 11.
Figure 13:
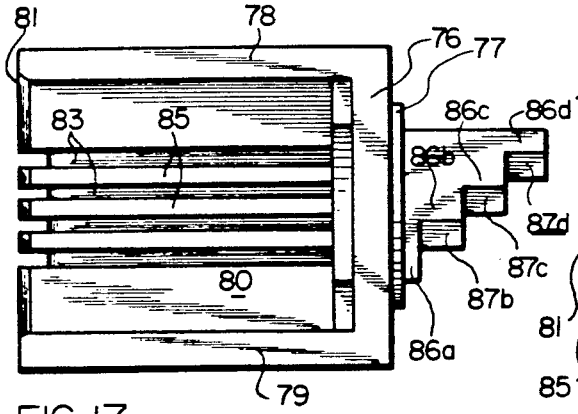
FIG. 13 is a plan view of the female modular connector.
Figure 14:
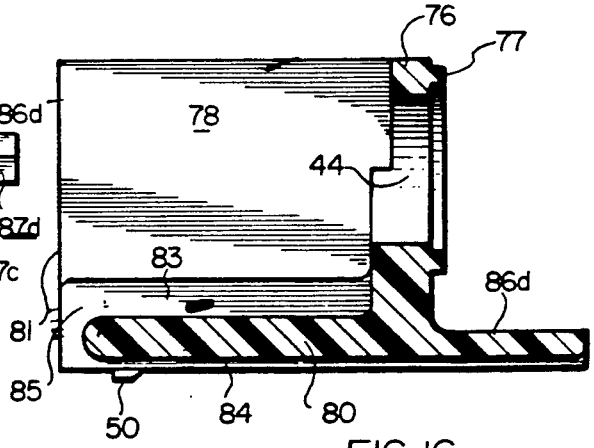
FIG. 14 is a sectional view taken along line 14—14 in FIG. 11.

Referring now to FIGS. 11–15, female modular connector 37 includes, in addition to inner wall 76, a pair of sidewalls 78, 79 a bottom wall 80, and an open outer end 81 and an open top. Bottom wall 80 has upper grooves 83 and lower grooves 84. Upper grooves 83 are separated from each other by dividers 85 which also separate lower grooves 84 from each other. Projecting from bottom wall 80 at end wall 76 is a sequence of extensions 86*a–d* of sequentially increasing length. As shown in FIGS. 12 and 13, extensions 86*b–*86*d* have upwardly sloping sidewalls 87*b–d*.

Each upper and lower groove 83, 84 receives and confines against lateral movement a connective portion 39 extending between a contact element 38 and a wiper 36 (FIG. 2). Extensions 86*a–*86*d* provide support for the innermost part of connective portion 39 (to the right in FIG. 2), and sloping surfaces 87*b–d* accommodate flexing of wiper 36 in a lateral direction toward the sloping surface.

Figure 17:
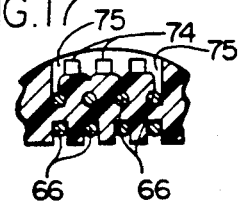
FIG. 17 is a fragmentary sectional view, similar to FIG. 4, showing an expedient employed in one embodiment of the present invention.

The rotary connector is assembled in a manner now to be described, with particular reference to FIGS. 1 and 2. Cable end portion 40 and cable 41 are initially inserted through housing opening 43 at housing end 22, all the way through housing 20, until cable end portion 40 is located outside of housing end 21. Cable end portion 40 is then inserted through channel 32 in connector member 27 so that insulated and uninsulated wire parts 65, 66 respectively are received in pocket 30 following which uninsulated wire parts 66 are bent around shelf 65 in the manner shown in FIG. 2 wherein the free end 68 of each uninsulated wire part 66 is received in a respective slit 31 of member 27. Pinch element 70 is then deformed to the disposition shown in FIG. 2 to help hold cable end portion 40 in place. In addition, the terminal portions of dividers 74 may be thermally deformed to at least partially envelope uninsulated wire parts 66 in passageways 75 (see FIGS. 4 and 17) to help hold wire parts 66 in place in passageways 75, against a pull on cable 41.

The conductive members, each composed of contact element 38, connective portion 39 and wiper 36, are assembled on female modular connector element 37. Then spindle shaft 45 is inserted into opening 44 in female modular connector element 37, and wipers 36, composed of a resilient, springy material, are then engaged in their respective peripheral grooves 56 on spindle 23. These engagements hold spindle 23 and female modular connector element 37 together as a sub-assembly. Before the spindle was engaged with the female modular connector element, the spindle rings 35 and their corresponding connector elements 59 were assembled in place, and the uninsulated terminal portion 62 of each connector 59 was bent up and back into a respective shallow groove 63 on a surface of spindle shank 26, as previously described.

After spindle 23 and female modular connector element 37 have been arranged in the above-described sub-assembly, spindle shank 26 is inserted into pocket 30 on member 27, to effect the previously described male-female mating engagement, and to effect the engagement between uninsulated terminal portions 62 of connector 59 and uninsulated wire part 66 of cable end portion 40. This, in turn, creates a larger sub-assembly consisting of female modular connector 37, spindle 23 and connector member 27. This larger sub-assembly is then inserted into housing 20, with cable 41 being withdrawn back through the housing until shank 34 on member 27 is received within opening 43 at housing end 22, and thrust-bearing 29 on the interior of housing 20, at housing end 22, engages end 29 on member 27. Essentially simultaneously, bottom lugs 50 on female modular connector 37 engage bottom openings 51 on housing 20 to lock element 37 and housing 20 together. Element 37 is located sufficiently deep within housing 20 so that the housing closes the open top on element 37, thereby protecting the previously unprotected, exposed contact elements 38.

Male modular connector element 33 may be assembled at cable end portion 42, in a conventional manner, either before or after cable end portion 40 is connected to member 27.

Except as otherwise indicated herein, many of the components of the rotary connectors described in the above-identified Ditzig U.S. Pat. Nos. 4,673,228, 4,764,121 and 4,854,881 are similar to many of the components described herein, except, of course, for the modifications and additions described herein, such as connector member 27. Accordingly, the disclosures of the above-identified earlier Ditzig U.S. Patents are incorporated herein by reference with respect to the details of the components which are also disclosed to a substantial extent herein.

The foregoing detailed description has been given for clearness of understanding only, and no unnecessary limitations should be understood therefrom, as modifications will be obvious to those skilled in the art.

I claim:

1. A rotary connector comprising:

a housing having a pair of opposite ends and an axis of rotation;

a spindle disposed within said housing along said axis of rotation;

said spindle having a pair of opposite ends;

a plurality of spindle rings on said spindle;

a plurality of wipers within said housing, each of said wipers comprising means for engaging a respective one of said spindle rings;

male and female connector members in mating engagement with each other within said housing;

a first of said connector members being located at one end of said spindle and having a plurality of exposed contact elements each electrically connected to one of said spindle rings;

a second of said connector members being separate and discrete from said spindle and said housing and being located adjacent said one spindle end;

said second connector member having a plurality of exposed contact elements located between said one spindle end and one end of said housing, each of said contact elements on the second connector member comprising means for engaging a respective exposed contact element on the first connector member when said connector members are in said mating engagement;

a cable having one cable end electrically connected to the exposed contact elements on said second connector member, and another cable end spaced from said one cable end and located outside said housing;

and means mounting said housing for rotation relative to said spindle and said first and second connector members.

2. A rotary connector as recited in claim 1 wherein:

said one cable end comprises a plurality of wires terminating at respective uninsulated wire parts constituting said exposed contact elements on said second connector member.

3. A rotary connector as recited in claim 2 wherein:

each exposed contact element on the first connector member is connected to a respective spindle ring by one of a plurality of electrically conductive connecting means, each extending through said spindle, each exposed contact element constituting an uninsulated terminal portion located outside said spindle adjacent said one spindle end one end connected to a respective said contact element;

and means on said first and second connector members cooperating to hold each uninsulated part of a respective cable wire in electrically conducting, press-fit engagement with a corresponding said uninsulated terminal portion on the connecting means.

4. A rotary connector as recited in claim 1 and comprising:

a male modular connector at said other cable end and electrically connected thereto; and a female modular connector mounted for rotation with said housing;

said female modular connector having exposed contact elements electrically connected to said wipers.

5. A rotary connector as recited in claim 4 wherein:

said female modular connector comprises a pair of side walls, a bottom wall extending between said side walls, and a plurality of grooves on the lower surface of said bottom wall;

said contact elements are located between said side walls and above said bottom wall;

a plurality of connective portions each received in a respective said groove in said bottom wall;

each connective portion has one end connected to a respective contact element and another end connected to a respective wiper;

said female modular connector comprises a plurality of extensions projecting from said bottom wall, each extension being in substantial alignment with a respective groove and containing a terminal portion of said groove;

each of said connective portions is disposed along one of said extentions;

and each extension has a length corresponding to the length of that part of the connective portion disposed alongside said extension.

6. A rotary connector as recited in claim 5 wherein:

each extension has a surface sloping upwardly relative to the bottom wall of the female modular connector element.

7. A rotary connector as recited in claim 3 wherein:

said first connector member is a male member;

said spindle has a shank extending from said one spindle end constituting said male connector member;

said second connector member is a female member and comprises a pocket for receiving said spindle shank and said terminal portions of said connecting means;

and said cable wires extend into said pocket.

8. A rotary connector as recited in claim 7 wherein:

said spindle shank has an outer surface;

said pocket has an inner surface;

said uninsulated part of each cable wire has a free end;

and said cooperating means comprises (a) means on said outer surface of said spindle shank and (b) means on said inner surface of said pocket for sandwiching, between said surfaces, a plurality of component pairs each comprising (i), as one component, an uninsulated part of one of said cable wires and (ii), as the other component, a respective uninsulated terminal portion of the connecting means, with each component of said pair extending in longitudinal, side-by-side, contacting relation.

9. A rotary connector as recited in claim 8 wherein said second connector member comprises:

a slit for receiving said free end of a cable wire when said uninsulated part of the wire is in said sandwiched relation with a terminal portion of the connecting means.

10. A rotary connector as recited in claim 8 wherein said second connector member comprises:

first and second ends spaced apart in an axial direction;

said pocket extending inwardly into said second connector member from said first end;

an internal channel extending in an axial direction from said pocket to said second end;

a part of said cable end portion which is received within said second connector member being disposed within said channel.

11. A rotary connector as recited in claim 10 wherein said second connector member comprises:

means for pinchingly engaging that part of the cable end portion disposed within said channel, to prevent said cable from being withdrawn from said second connector member.

12. A rotary connector as recited in claim 8 wherein:

said pocket has an outer end portion, for receiving said spindle shank, and an inner end portion;

and said second connector member comprises divider means, at the inner end portion of said pocket, defining a first plurality of passageways each for receiving a respective insulated cable wire part.

13. A rotary connector as recited in claim 12 wherein:

said divider means defines a second plurality of passageways, spaced from said first plurality of passageways, each for receiving a respective uninsulated cable wire part.

14. A rotary connector as recited in claim 13 and comprising:

a shelf defining one wall of said pocket and separating said first plurality of passageways from said second plurality of passageways;

said shelf having a pair of opposed surfaces each terminating at an outer end portion of the shelf;

said uninsulated wire part being bent around said outer end portion of the shelf.

15. A rotary connector as recited in claim 14 wherein:

each of said second plurality of passageways has an open end and a closed end;

and said second connector member comprises a slit adjacent said closed end for receiving said free end of said uninsulated part of said wire.

16. A rotary connector as recited in claim 8 wherein:

said pocket has an open outer end and comprises means for guiding a spindle shank inserted into said pocket through said open outer end, to bring said uninsulated cable wire parts and said uninsulated terminal portions on the connecting means into said contacting relationship.

17. A female modular connector for use in a rotary connector, said female modular connector comprising:

a pair of side walls and a bottom wall extending between said side walls;

a plurality of grooves on the bottom surface of said bottom wall;

a plurality of contact elements located between said side walls and above said bottom wall;

a plurality of connective portions each having one end connected to a respective said contact element;

each connective portion being received in a respective groove on said bottom wall;

a plurality of extensions projecting from said bottom wall, each extension being in substantial alignment with a respective groove and containing a terminal portion of said groove;

each of said extensions having a length which increases sequentially in a direction proceeding from one of said side walls toward the other side wall.

18. A female modular connector as recited in claim 17 wherein:

there are two outer extensions and two inner extensions;

said inner extensions and one of said outer extensions each comprises a surface sloping upwardly from the bottom of said extension;

and there are a plurality of wipers each connected to the outer end of a respective connective portion and each extending upwardly from said connective portion alongside a respective upwardly sloping surface of said projection.

19. A sub-assembly for a rotary connector, said sub-assembly comprising:

a spindle having an axis and a pair of opposite ends;

a plurality of spindle rings on said spindle; direction from one spindle end;

a plurality of electrically conductive connecting means each extending within said spindle from a respective spindle ring, through the spindle shank, to an uninsulated terminal portion located outside said spindle and adjacent said one spindle end;

a cable having an end portion comprising a plurality of electrically conductive wires each terminating at an uninsulated part corresponding to a respective one of said connecting means;

a female connector member comprising means for receiving and engaging said spindle shank;

said female connector member comprising means for receiving said end portion of the cable;

and means on said female connector member and on said spindle shank cooperating to hold each said uninsulated part of a cable wire in electrically conducting press-fit engagement with a corresponding said uninsulated terminal portion on the connecting means when the spindle shank is received and engaged by said female connector member.

20. A sub-assembly as recited in claim 19 wherein:

said female connector member has a pocket for receiving said spindle shank and said terminal portions of said connecting means;

and said cable wires extend into said pocket.

21. A sub-assembly as recited in claim 20 wherein:

said spindle shank has an outer surface;

said pocket has an inner surface;

said uninsulated part of each cable wire has a free end;

and said cooperating means comprises (a) means on said outer surface of said spindle shank and (b) means on said inner surface of said pocket for sandwiching, between said surfaces, a plurality of component pairs each comprising (i), as one component, an uninsulated part of one of said cable wires and (ii), as the other component, an uninsulated terminal portion of the connecting means, with each component of said pair extending in longitudinal, side-by-side, contacting relation.

22. A sub-assembly as recited in claim 21 wherein said female connector member comprises:

a slit for receiving said free end of a cable wire when said uninsulated part of the wire is in said sandwiched relation with a terminal portion of the connecting means.

23. A sub-assembly as recited in claim 21 wherein said female connector member comprises:

first and second ends spaced apart in an axial direction;

said pocket extending inwardly into said female connector member from said first end;

an internal channel extending in an axial direction from said pocket to said second end of said female connector member;

a part of said cable end portion which is received within said member being disposed within said channel.

24. A sub-assembly as recited in claim 21 wherein:

said pocket has an outer end portion, for receiving said spindle shank, and an inner end portion;

and said female connector member comprises divider means, at the inner end portion of said pocket, defining a first plurality of passageways each for receiving a respective insulated cable wire part.

25. A sub-assembly as recited in claim 24 wherein:

said divider means defines a second plurality of passageways, spaced from said first plurality of passageways, each for receiving a respective uninsulated cable wire part.

26. A sub-assembly as recited in claim 25 wherein:

each of said second plurality of passageways has an open end and a closed end;

and said female connector member comprises a slit adjacent said closed end for receiving said free end of said uninsulated part of said wire.

27. A sub-assembly as recited in claim 21 wherein:

said pocket has an open outer end and comprises means for guiding a spindle shank, inserted into said pocket through said open outer end, to bring said uninsulated cable wire parts and said uninsulated terminal portions on the connecting means into said contacting relationship.

* * * * *